United States Patent [19]

Suligoy et al.

[11] Patent Number: 4,461,192

[45] **Date of Patent: * Jul. 24, 1984**

[54] PIVOT TIP HAND TOOL

[76] Inventors: Diane Suligoy, R.R. 5, Mound Rd., Joliet, Ill. 60436; Sharon Cook, 9704 Stacy, Union, Ill. 60180

[ * ] Notice: The portion of the term of this patent subsequent to Jun. 9, 1998 has been disclaimed.

[21] Appl. No.: 246,451

[22] Filed: Mar. 23, 1981

Related U.S. Application Data

[63] Continuation-in-part of Ser. No. 73,159, Sep. 7, 1979, Pat. No. 4,271,731.

[51] Int. Cl.[3] ..... B25G 1/00; B25B 13/00

[52] U.S. Cl. ..... 81/177 ST; 81/177.8

[58] Field of Search ..... 81/177 R, 177 ST, 177.8, 81/177.9, 440, 450; 7/168

[56] References Cited

U.S. PATENT DOCUMENTS 750,182 1/1904 Furbish ..... 81/440 X 3,604,486 9/1971 Henry ..... 81/450

FOREIGN PATENT DOCUMENTS 2246178 3/1974 Fed. Rep. of Germany ..... 81/440

*Primary Examiner*—James G. Smith

[57] ABSTRACT

A pivot tip hand tool comprising in one embodiment an elongated shank, an axial recess or bore therein opening to the work-piece end, a work-piece shaft positioned in said bore for relative sliding movement between a retracted position and an extended position, a first lock assembly to hold said shaft in the extended position until released, a socket member pivotally mounted on the work-piece shaft having a socket for receiving the shank of a tool such as a screwdriver therein, the socket member being pivotable between a first position in which its socket is axially aligned with the work-piece shaft and a second position in which its socket is at a substantially right angle to said shaft, and a second lock assembly to hold said socket member in said first and second positions, respectively, until released. In a second embodiment, an additional lock assembly is provided to hold said shaft in the retracted position relative to said elongated shank having the axial bore therein.

11 Claims, 29 Drawing Figures

PIVOT TIP HAND TOOL

BACKGROUND OF THE INVENTION

This is a continuation-in-part of application Ser. No. 73,159 filed Sept. 7, 1979, now U.S. Pat. No. 4,271,731. This invention relates to the field of hand tools having a pivot or swivel tip work-piece.

Other devices of this kind known to the prior art included a distributor adjustment tool having a pivotal hexagonal headed tool bar as described in U.S. Pat. No. 4,028,968; a screwdriver whose handle may be adjusted angularly to different positions as set forth in U.S. Pat. No. 3,773,094; a multiple tool bit work-piece which may be rotated 180 degrees to position four different work-pieces in axial alignment with the shank of the tool as disclosed in U.S. Pat. Nos. 3,014,388 and 2,933,963; and a ratchet tool having an angularly adjustable handle as disclosed in U.S. Pat. No. 2,656,865. Another prior art device of some relevance to the invention which is the subject of this application is described in U.S. Pat. No. 3,351,111, disclosing a tool having holding means in which a portion extends into the bore of the shank.

One of the problems with prior art devices of this kind is maintaining rigidity of the pivotal work-piece end, while at the same time enabling quick and easy movement of the pivot tip work-piece end from one working position to another. The present invention solves such problems by use of a work-piece shaft slidably received in the bore of the hand tool's shank which can be easily locked and released in both an extended and retracted position, and a pivotable work-piece pivotally mounted on the end of the work-piece shaft which can be easily locked and released in both an axially aligned position and one at right angles to the work-piece shaft.

SUMMARY OF THE INVENTION

It is an object of the invention to provide a pivot tip hand tool having a work-piece pivotally mounted at one end which may be rigidly held in a plurality of different working positions and which may be easily released from one working position and pivotally moved to another.

It is an object of the invention to provide a pivot tip hand tool, having an elongated shank, an axial bore in said shank opening to the work-piece end, a work-piece shaft slidably positioned in said axial bore between a retracted and an extended position, first lock means to hold said shaft in at least the extended position, a work-piece end member pivotally mounted at one end of said work-piece shaft, and second lock means to lock said work-piece end in a plurality of different working positions.

It is an object of the invention to provide a pivot tip hand tool, having an elongated member connected to a hand grasp member, an axial bore in said elongated member opening to a work-piece end, a work-piece shaft connected to said hand grasp member and extending from said work-piece end of said elongated member, said elongated member and said work-piece shaft being in sliding relationship between a retracted and extended position, first holding means to hold in said extended position, a work-piece end member pivotally mounted on said work-piece shaft, and second holding means to hold said work-piece end in a plurality of different working positions.

It is an object of the invention to provide a pivot tip hand tool, having an elongated tubular member connected at one end to a hand grasp member, an axial bore in said elongated tubular member opening to a work-piece end, a work-piece shaft slidably received in said axial bore of said elongated tubular member with one end thereof projecting outwardly from said opening at said work-piece end, said work-piece shaft being slidable in said axial bore between a retracted first position and an extended second position, first holding means to hold said work-piece shaft in said extended second position, a work-piece end member pivotally mounted on the end of said work-piece shaft which projects outwardly from said axial bore of said elongated tubular member, and second holding means to hold said work-piece end in a first working position in axial alignment with said work-piece shaft and in a second working position at a substantially 90 degree angle to said work-piece shaft.

It is an object of the invention to provide a pivot tip hand tool, having a work-piece shaft connected at one end to a hand grasp member, an elongated tubular member having axial bore therethrough slidably mounted on said work-piece shaft for reciprocating movement between a first position, in which the free end of said work-piece shaft is retracted relative to said elongated tubular member and is received into said axial bore of said elongated tubular member, and a second position in which said free end of said work-piece shaft is extended relative to said elongated tubular member and extends outwardly from said axial bore thereof, a work-piece end member pivotally mounted on the free end of said work-piece shaft, first holding means to hold said elongated tubular member in said first position, and second holding means to hold said work-piece end in a first working position in axial alignment with said work-piece shaft and in a second working position at a substantially 90 degree angle to said work-piece shaft.

DESCRIPTION OF PREFERRED EMBODIMENT

Figure 1:
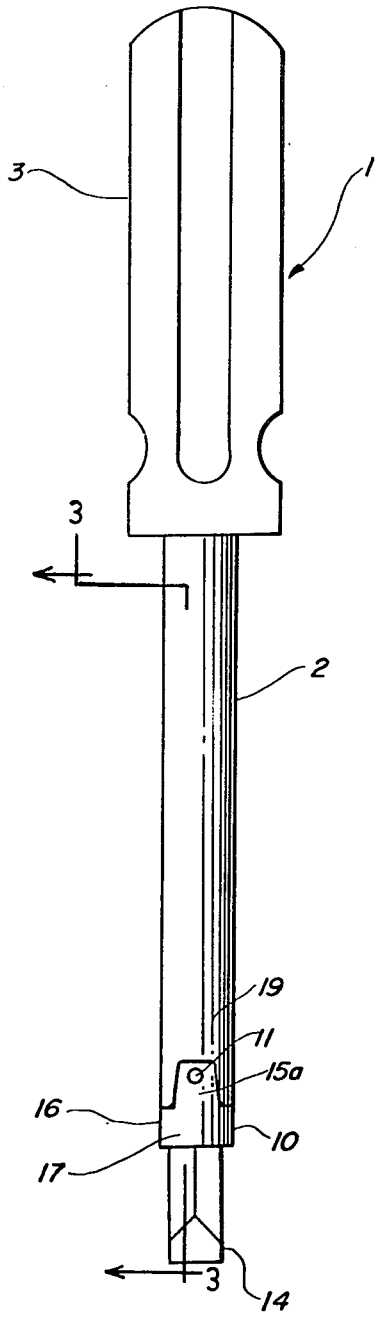
FIG. 1 is an elevation view of a hand tool in accordance with this invention, showing the pivot tip work-piece in the position of axial alignment with the shank of the tool.

A hand tool 1 in accordance with this invention includes an elongated shank 2 extending from the handle 3, in which an elongated axial bore or recess 4 is provided having a polygonal cross-section and bounded by a hexagonal inner wall 5. The recess 4 opens to the work-piece end 6 of the elongated shank 2.

Figure 2:
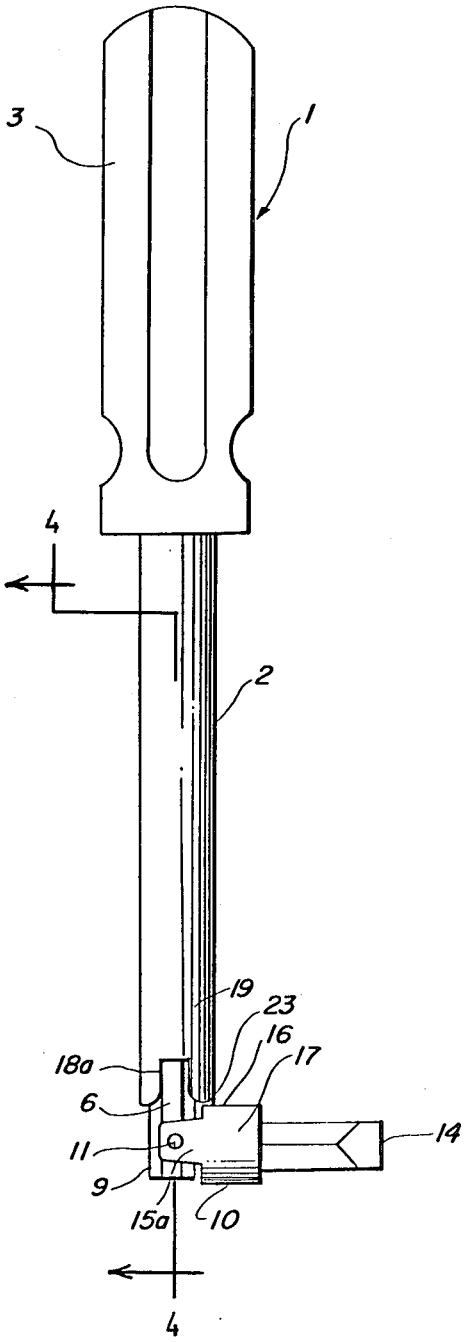
FIG. 2 is an elevation view of the hand tool of FIG. 1, showing the pivot tip work piece in the position which is at a right angle to the shank of the tool.
Figure 3:
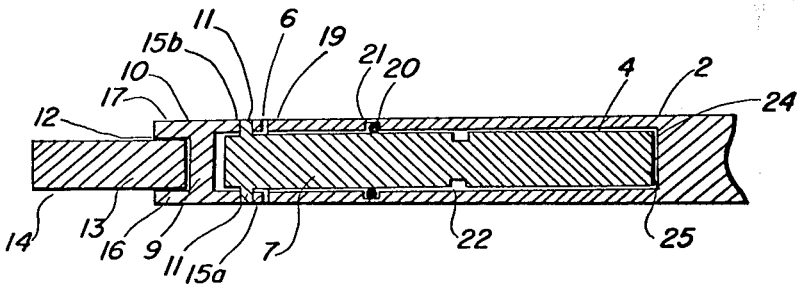
FIG. 3 is a section taken on line 3—3 of FIG. 1.
Figure 4:
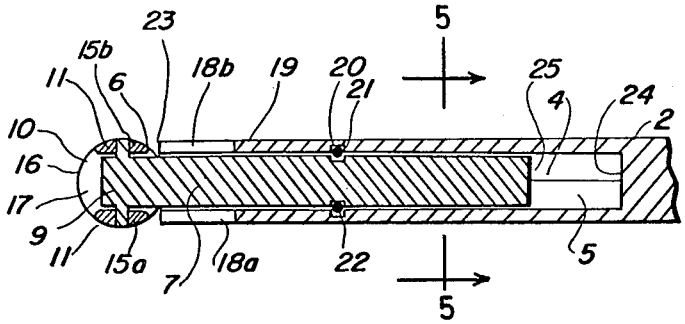
FIG. 4 is a section taken on line 4—4 of FIG. 2.
Figure 5:
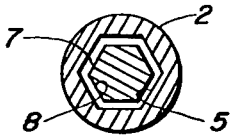
FIG. 5 is a section taken on line 5—5 of FIG. 4.
Figure 6:
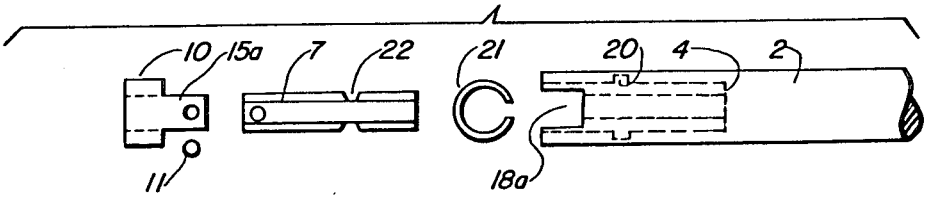
FIG. 6 is an exploded view of the work-piece end of the hand tool of FIG. 1.

A work-piece shaft 7, having a polygonal cross-section corresponding to that of the recess 4 and including a hexagonal peripheral wall surface 8, is slidingly positioned in recess 4 for reciprocal movement between a retracted position (as shown in FIGS. 1 and 3) and an extended position (as shown in FIGS. 2 and 4). A projecting end portion 9 of the work-piece shaft 7 extends outwardly of recess 4 when in the extended position.

A socket member 10 is pivotally attached to the projecting end portion 9 of shaft 7 by means of pivot pins 11. The socket member 10 includes a socket cavity 12 having a conventional polygonal or ribbed cross-section to receive the correspondingly cross-sectioned shank end 13 of a tool 14 such as the screwdriver tip shown in the drawing.

The socket member 10 includes a pair of ears 15*a* and 15*b* which extend longitudinally from opposite sides of the wall 16 to the body portion 17 of the socket member 10. The pivot pins 11 are seated in the ears 15 at one end, and anchored to the projecting end portion 9 of the slidable shaft 7 at their other end, to pivotally mount the socket member 10 on the end portion 9 of shaft 7.

A pair of notches or grooves 18*a* and 18*b* are provided in the wall 19 of the elongated shank 2 at the work-piece end portion 6, shaped and dimensioned to snugly receive ears 15*a* and 15*b* respectively therein when socket member 10 is pivoted to the axially aligned position with respect to work-piece shaft 7 and said shaft 7 is in the retracted position. The grooves 18*a* and 18*b* lock the socket member 10 in such axially aligned position when the ears 15*a* and 15*b* are seated therein.

An annular recess or groove 20 is provided around the inner wall 5 of the bore 4 of the elongated shank 2, at an intermediate location, said groove 20 opening to the recess or bore 4. A snap ring 21, comprising a C-shape spring metal member and being compressible and expandable, is seated in the annular recess or groove 20.

A locking groove 22 is formed around the periphery of the work-piece shaft 7 at a location thereon which is in registration with annular groove 20 around inner wall 5 of the bore 4 of elongated shank 2 when said work-piece shaft 7 is in its extended position. When said grooves 20 and 22 are in registration with each other, the snap ring 21 snaps into locking grooves 22 far enough to hold the shaft 7 in its extended position, a portion of snap ring 21 remaining seated in annular groove 20.

When shaft 7 is in its extended position, the ears 15*a* and 15*b* are out of the grooves 18*a* and 18*b*, thereby permitting the socket member 10 to be pivoted on pivot pins 11 from a first work position in axial alignment with the elongated shank 2 and work-piece shaft 7, to a second work position in which the longitudinal axis of the socket member 10 is normal to the longitudinal axes of the elongated shaft 2 and the work-piece shaft 7 mounted coaxially with elongated shank 2 in the axial bore 4.

The socket member 10, work-piece shaft 7 and elongated shaft 2 are preferably of ferrous metal, with one or more magnetized at the region of the work-piece end 6. Thus, when socket member 10 is pivoted to the second work position at substantially a right angle to the elongated shaft 2, the magnetized end 6 of elongated shaft 2 will attract the ferrous metal of socket member 10 at the point 23 where it meets elongated shaft 2 to form the right angle, to magnetically hold the socket member 10 in the said second work position.

The work-piece shaft 7 and socket member 10 both being held in position respectively by two separate locking or holding means, gives the pivotable socket member 10 in the second work position substantial rigidity and stability in that position which approaches that of a non-pivotable socket member which was rigidly affixed or integrally formed in that position. The two separate locking or holding means include (1) the snap ring 21 and locking groove 22 for the work-piece shaft 7, and (2) the magnetized portions of one or more of the elongated shaft 2, the work-piece shaft 7, and the socket member 10 in the region of the work-piece end 6 and the area 23 adjacent the substantially ninety degree angle bounded by the elongated shaft and socket member 10, as the holding means for socket member 10 in the second work position.

Similarly in the first work position in which the axis of socket member 10 is axially aligned with the axes of elongated shank 2 and work-piece shaft 7, there are also two separate locking or holding means to give the pivotable socket member 10 in this first work position substantial rigidity and stability approaching that which an integrally formed or rigidly affixed, non-pivotable socket member would have. The two separate locking or holding means include (1) the ears 15*a* and 15*b* of socket member 10 received snugly within the notches or grooves 18*a* and 18*b* of elongated shank 2, as far as the socket member 10 is concerned, and (2) the abutting end wall 24 of the axial recess 4 in elongated shank 2 and the inwardly extending end 25 of work-piece shaft 7 which abuts against end wall 24 when shaft 7 is in its retracted position, as far as the work-piece shaft 7 is concerned.

Figure 7:
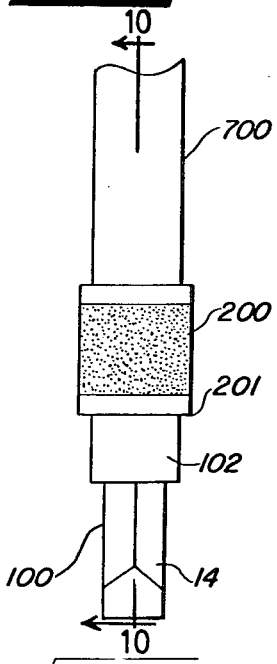
FIG. 7 is an elevation view of the working end portion of a modification of a hand tool in accordance with this invention, showing a retractable collar in its extended position.
Figure 8:
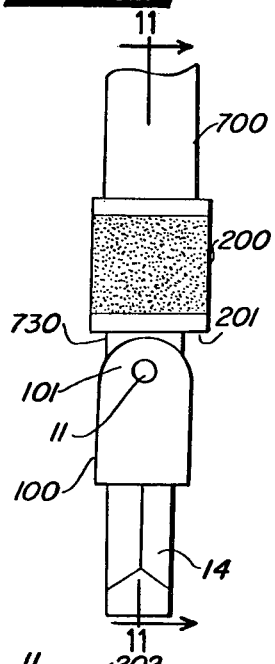
FIG. 8 is an elevation view of the device in FIG. 7, showing the retractable collar in its retracted position.
Figure 9:
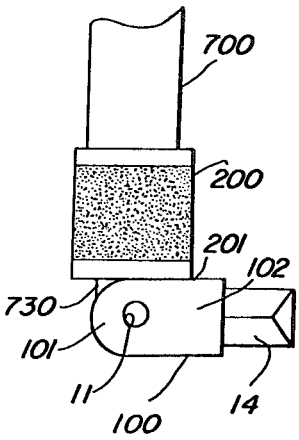
FIG. 9 is an elevation view of the device in FIG. 8, showing the pivot tip end at a right angle relative to the axis of the retractable collar.
Figure 10:
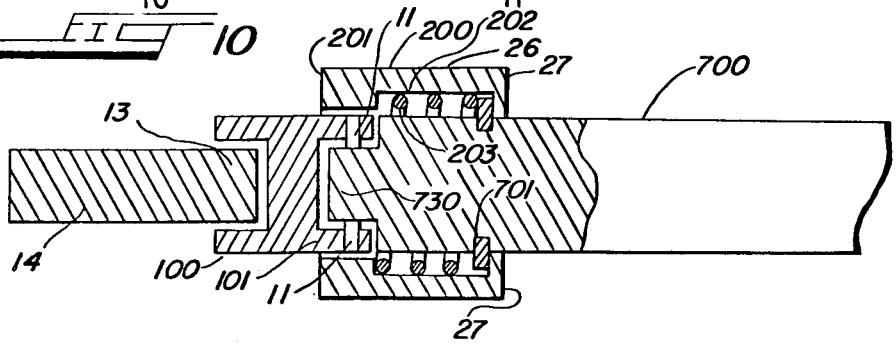
FIG. 10 is a section taken on line 10—10 of FIG. 7.
Figure 11:
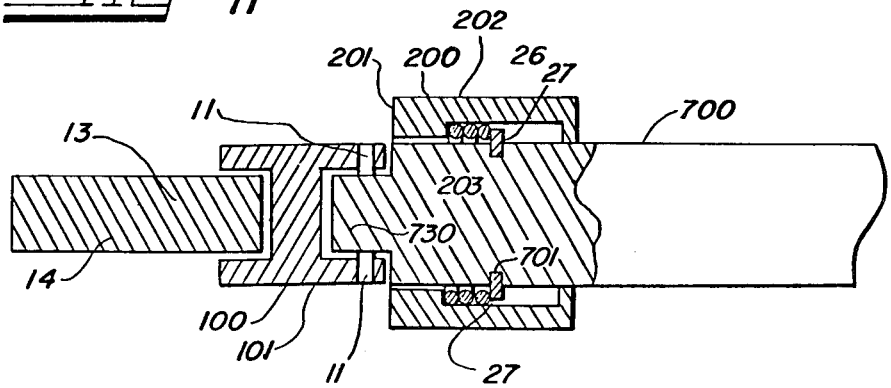
FIG. 11 is a section taken on line 11—11 of FIG. 8.

A modification of the invention is shown in FIGS. 7–11. Instead of a work-piece shaft 7 sliding in and out of a recess in the elongated shaft 2 of the hand tool to change positions of the pivot tip socket member 100, the work-piece shaft 700 of the modification is held stationary and an elongated collar 200 which surrounds the shaft 700 is moved back and forth between a retracted position (as shown in FIGS. 8 and 11) and an extended position (as shown in FIGS. 7 and 10).

In the extended position, the leading edge 201 of collar 200 snugly overlaps the pivotal end portion 101 of socket member 100 thereby holding socket member 100 in the first work position of axial alignment with the work-piece shaft 7.

In the retracted position, the leading edge 201 of collar 200 clears the pivotal end portion 101 of socket member 100 thereby enabling socket member 100 to pivot on pivot pins 11 to the second work position in which the axis of socket member 100 is substantially normal to the longitudinal axis of the work-piece shaft 7. FIG. 9 shows the work-piece end of the modified hand tool of this invention in the second position.

A coil compression spring 26 is seated in an annular recess 202 of the elongated collar 200. One end of the spring 26 rests against annular ring 27, which is seated in annular groove 701 of the work-piece shaft 700. The other end of the spring 26 rests against an annular ledge 203 at the end of the annular recess 202 nearest the work-piece end 830 of the work-piece shaft 700, whereby the elongated collar 200 is normally biased toward the work-piece end 730 which is the extended position of collar 200.

When the socket member 100 is pivoted to the second work position as shown in FIG. 9, the leading edge 201 of collar 200 presses against the side wall 102 of socket member 100 under the bias of spring 26, to hold it in such second position.

To operate the pivot tip hand tool in accordance with this invention, starting with the first work position, the work-piece shaft 7 is pushed inwardly until its inwardly facing end 25 abuts against the abutting end wall of axial recess 4 of the elongated shaft 2, and the ears 15*a* and 15*b* of socket member 10 are fully seated in the notches or grooves 18*a* and 18*b* respectively. A screwdriver tip or other tool bit is seated in socket member 10, and the tool is ready for use in the first work position.

To change the socket member 10 to the second work position, the work-piece shaft 7 is pulled outwardly until annular snap ring 21 seats in the annular locking groove 22 to hold work-piece 7 in the extended position. The ears 15*a* and 15*b* of socket member 10 are at such time completely out of the grooves 18*a* and 18*b*, whereupon socket member 10 can be pivoted on pivot pins 11 to the second work position, in which its axis is substantially normal to the axes of the elongated shank 2 and work-piece shaft 7. The magnetized portions of one or more of the elongated shank 2, work-piece shaft 7 and socket member 10 magnetically hold the socket member 10 in such second work position until it is desired to change back to the first work position.

To do so, requires only pivoting the socket member 10 back to the axial alignment position and pushing the work-piece shaft 7 into the retracted position. The screwdriver tip 14 or other tool bit extending from the socket member 10 can be grasped and used as a lever to overcome the magnetic attraction force of the magnetized pieces if necessary to pivot the socket member 10 from the right angle position to the axially aligned position. The end of the tool bit, or of the socket member 10, can be tapped if necessary to break the snap ring 21 out of the locking groove 22 to enable pushing the shaft 7 back into its retracted position.

In the modification shown in FIGS. 7–11, starting with the first work position, the socket member 100 is placed in the position of axial alignment with shaft 700, and elongated collar 200 is allowed to move to its extended position under the bias of spring 26 where it overlaps the pivot end portion 101 of socket member 101 holding it in said first work position.

To change the socket member 100 to the second work position, the collar 200 is drawn back to the retracted position at which its leading edge 201 clears the pivot end portion 101 of socket member 100. The socket member 100 is then pivoted on pivot pins 11 to the second work position in which its axis is substantially normal to that of shaft 700. The collar 200 is then released, allowing its leading edge 201 to move into contact with and bear against the adjacent portion of side wall 102 of socket member 100 under the bias of spring 26 to hold the socket member 100 in the second work position.

When it is desired to return the socket member 100 to the first work position of axial alignment, the socket member 100 is pivoted back to such position, the leading edge 201 of collar 200 being pushed rearwardly slightly against the bias of spring 26 to permit the pivot end 101 of socket member 100 to rotate into the axially aligned position. The collar 200 is then allowed to move to its extended position under the bias of spring 26 where it overlaps the pivot end portion 101 of socket member 100 and holds it snugly in axial alignment in the first work position.

Figure 12:
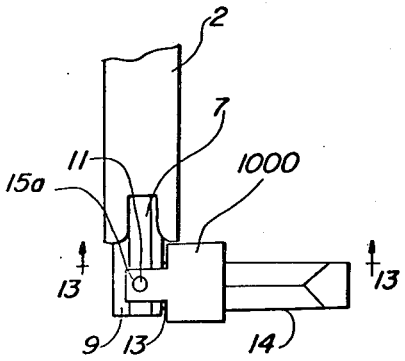
FIG. 12 is a side elevation of the pivot tip end of another modification of this invention shown pivoted to the right angle work position.
Figure 14:
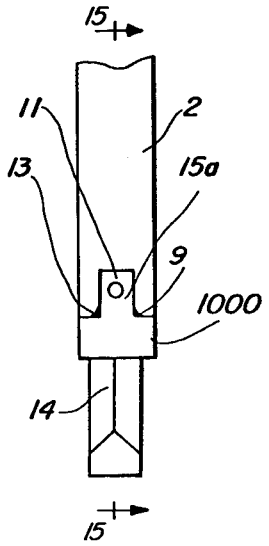
FIG. 14 is a side elevation of the pivot tip end of FIG. 12 shown in the axially aligned work position.
Figure 13:
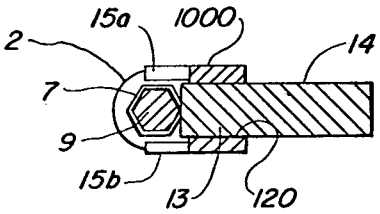
FIG. 13 is a section view taken on line 13—13 of FIG. 12.
Figure 15:
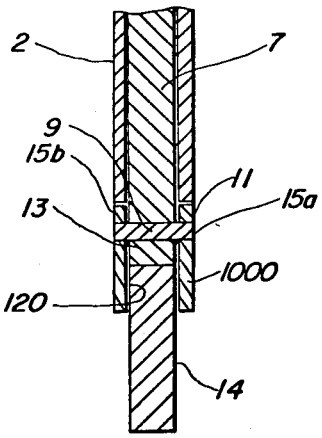
FIG. 15 is a section view taken on line 15—15 of FIG. 14.
Figure 16:
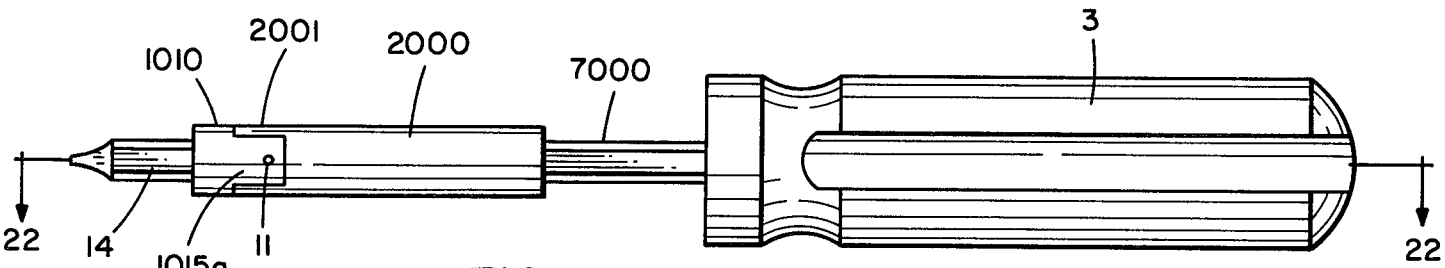
FIG. 16 is a side elevation of another modified form of the hand tool in accordance with this invention showing an elongated tubular member in a forward position on the work-piece shaft whereby the pivot tip end is retracted into the elongated tubular member and is locked in a first position in axial alignment with said work-piece shaft.
Figure 18:
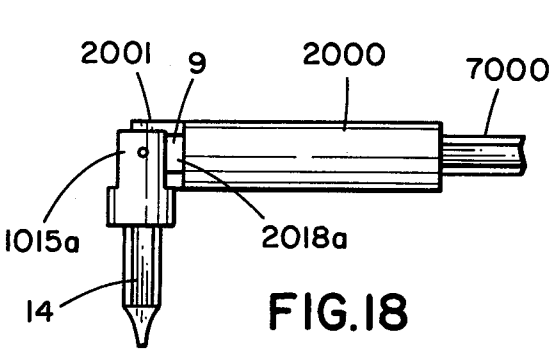
FIG. 18 is a side elevation of the hand tool of FIGS. 16 and 17 showing the pivot tip end pivoted to a second position which is substantially at a 90 degree position which is substantially at a 90 degree angle to said work-piece shaft, and showing the elongated tubular member still in the rearward position.
Figure 17:
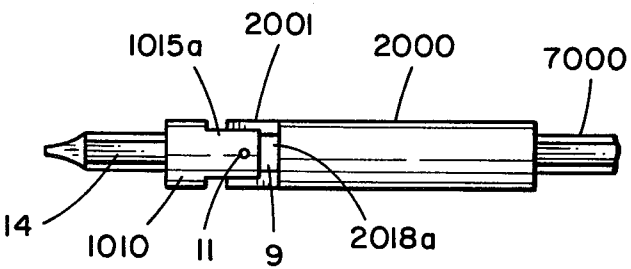
FIG. 17 is a side elevation of the hand tool of FIG. 16 showing the elongated tubular member moved to a rearward position on the work-piece shaft whereby the pivot tip end is extended from the elongated tubular member and is freed to pivot from said first position in axial alignment with the work-piece shaft to a second position.
Figure 19:
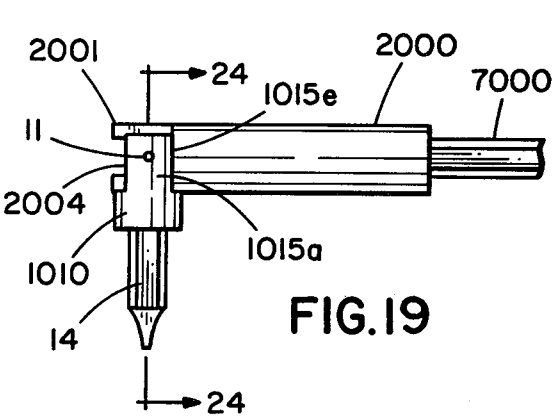
FIG. 19 is a side elevation of the hand tool of FIG. 18 showing the elongated tubular member moved back to the forward position as in FIG. 16, but in this case locking the pivot tip end in the 90 degree angle position shown in FIG. 18.
Figure 21:
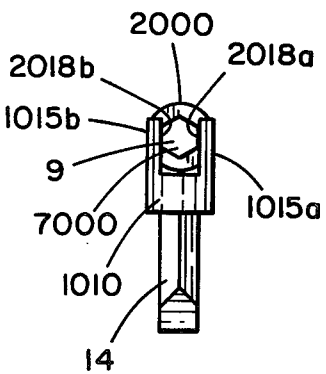
FIG. 21 is an end elevation view of the hand tool as shown in FIG. 19.
Figure 20:
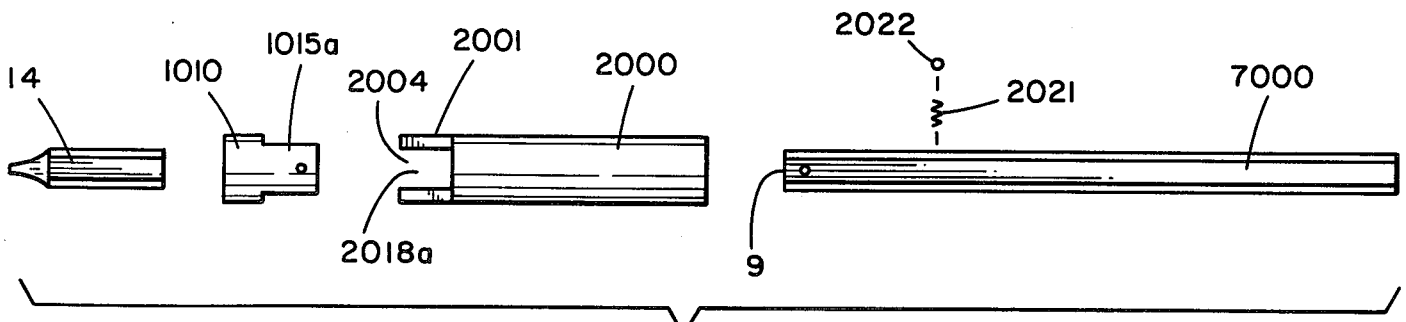
FIG. 20 is an exploded view of the hand tool shown in FIG. 16.
Figure 22:
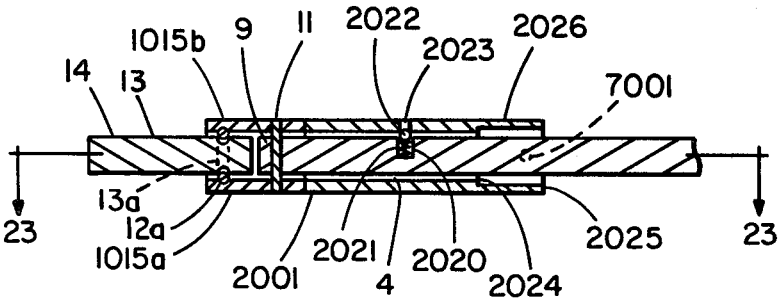
FIG. 22 is a sectional view taken on line 22—22 of FIG. 16.
Figure 23:
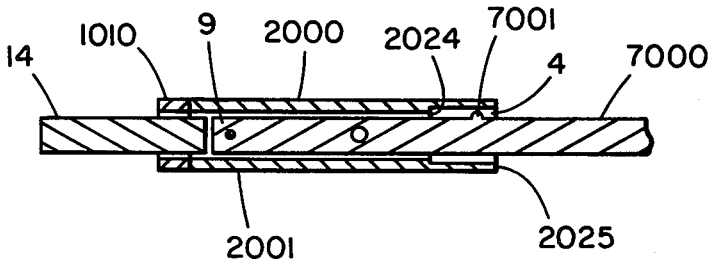
FIG. 23 is a sectional view taken on line 23—23 of FIG. 22.
Figure 24:
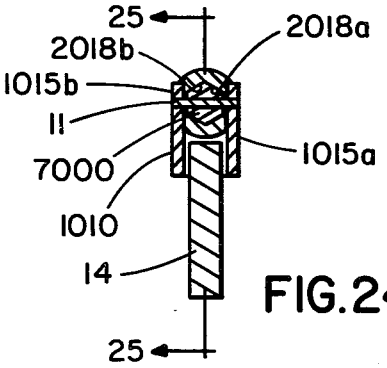
FIG. 24 is a sectional view taken on line 24—24 of FIG. 19.
Figure 25:
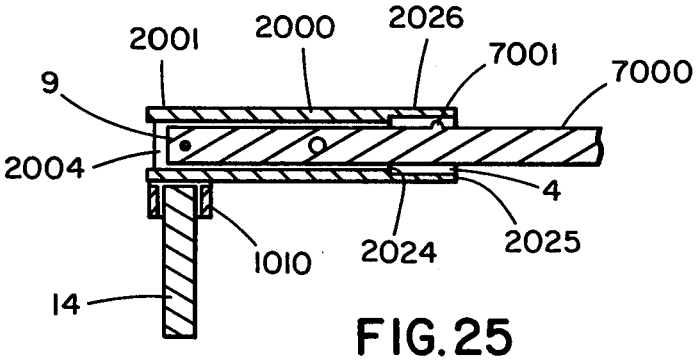
FIG. 25 is a sectional view taken on line 25—25 of FIG. 24.
Figure 26:
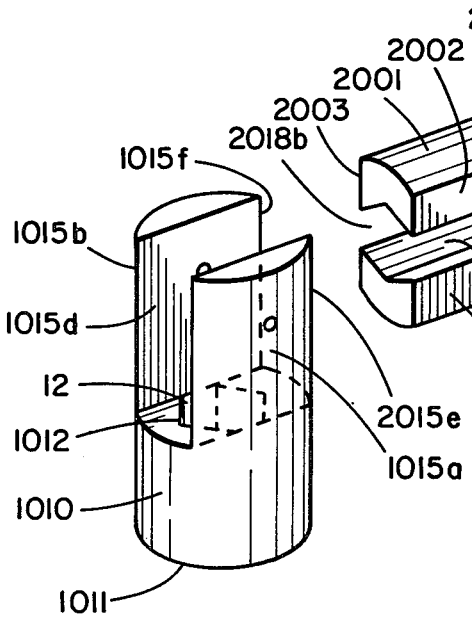
FIG. 26 is a perspective view of the pivot tip of FIG. 16.
Figure 27:
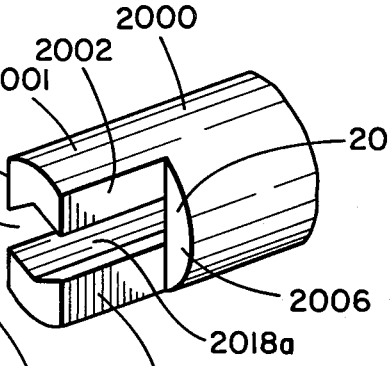
FIG. 27 is a perspective view of the elongated tubular member of FIG. 16.
Figure 28:
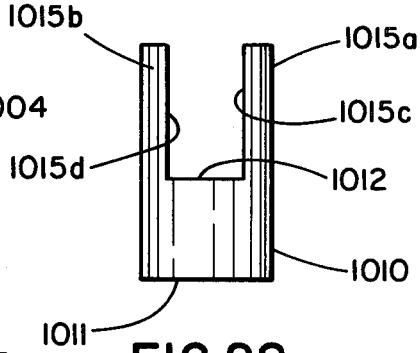
FIG. 28 is an end elevation view of the pivot tip member of FIG. 26.
Figure 29:
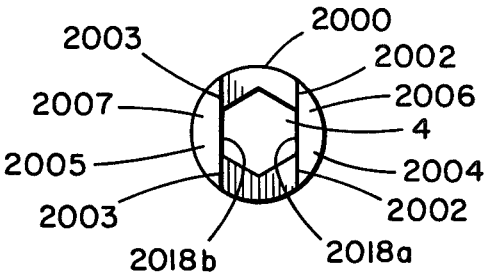
FIG. 29 is an end elevation view of the elongated tubular member of FIG. 27.

In the form of the invention shown in FIG. 12, the socket member 1000 includes a hexagonal axial bore 120 which extends all the way through, instead of the socket cavity 12. The shank end 13 of the tool 14 is inserted into and all the way through the axial bore 120 whereby it abuts against the end 9 of shaft 7 when in the axially aligned first work position as shown in FIGS. 14 and 15.

When the socket member 1000 is pivoted to the second work position as shown in FIG. 12 in which the axis of the socket member 1000 is substantially normal to the longitudinal axis of the work-piece shaft 7, the shank end 13 of tool 14 is pushed against a side wall portion of the end portion 9 of shaft 7. In this way, when tool 14 is applied to a work-piece and pushed thereagainst the shank end 13 is forced more firmly against the wall end 9 of work-piece shaft 7. Such pressure of the shank end 13 against the wall of shaft end portion 9 tends to hold this modification of socket member 1000 in the second work position. In fact, before the socket member 1000 can be pivoted back to the first axially aligned work position, the shank end 13 of the tool 14 has to be moved axially outward a sufficient distance to enable work-piece shaft end 9 to clear.

A further modification of the hand tool in accordance with this invention is shown in FIGS. 16–29. In this modification the work-piece shaft 7000 is fixedly and rigidly connected to the handle 3, similar to the modification shown in FIGS. 7–11. An elongated tubular member 2000 having an axial bore 4 is slidingly received on the shaft 7000. The axial bore 4 has a cross-sectional configuration and dimension corresponding to that of the shaft 7000, but sufficiently larger for the tubular member 2000 to be slidable on the shaft 7000 between a second forward position, in which the projecting end portion 9 of shaft 7000 is retracted inwardly of the elongated tubular member 2000, and a first rearward position, in which the projecting end portion 9 of shaft 7000 is extended from the elongated tubular member 2000.

The forward end portion 2001 of tubular member 2000 includes a pair of slots 2018*a* and 2018*b* extending longitudinally and rearwardly from the forward opening 2004 to the axial bore 4 on diametrically opposite sides thereof. The slots 2018*a* and 2018*b* extend rearwardly a distance which is substantially equal to the outer diameter of pivot tip member or socket member 1010 which is pivotally connected by pivot pins 11 to the projecting end portion 9 of work-piece shaft 7000.

The ears 1015*a* and 1015*b* of socket member 1010 of this embodiment of the invention have side wall dimensions substantially equal to the outer diameter of socket member 1010 and longitudinal dimensions which are substantially equal to the outer diameter of the elongated tubular member 2000. The inner walls 1015*c* and 1015*d* of the ears 1015*a* and 1015*b* are flat, spaced apart a distance substantially equal to the inner diameter of tubular member 2000 and of axial bore 4, as well as substantially equal to the cross-sectional dimension of work-piece shaft 7000.

The forward end portion 2001 of tubular member 2000 includes flat outward facing sides 2002 and 2003, which extend from both sides of slots 2018*a* and 2018*b* respectively, in first and second planes which are parallel and spaced apart a distance substantially equal to the inner diameter of tubular member 2000 and of axial bore 4, as well as substantially equal to the cross-sectional dimension of work-piece shaft 7000.

When socket member 1010 is pivotally mounted on end portion 9 of work-piece shaft 7000, and elongated tubular member 2000 is slidingly mounted on said work-piece shaft, the flat outward facing side 2002 of tubular member 2000 and the flat inner wall 1015*c* of the ear 1015*a* of socket member 1010 lie in the same first plane, and the oppositely disposed flat outward facing side 2003 of tubular member 2000 and the oppositely disposed flat inner wall 1015*d* of the ear 1015*b* of socket member 1010 lie in the same second plane.

The longitudinal slots 2018*a* and 2018*b* and respective flat outward facing sides 2002 and 2003 of elongated tubular member 2000 terminate inwardly at a junction with shoulders 2004 and 2005 respectively. Shoulder 2004 includes a flat face 2006 facing forwardly and extending at a substantially right angle outwardly from flat outward facing side 2002 and corresponding longitudinal slot 2018*a*. Shoulder 2005 includes a flat face 2007 facing forwardly and extending at a substantially right angle outwardly from flat outward facing side 2003 and corresponding longitudinal slot 2018*b*.

In operation, the elongated tubular member 2000 of this modification is slidingly moved rearwardly a sufficient distance to a first rearward position in which the end portion 9 of work-piece shaft is extended a sufficient distance to enable the ears 1015*a* and 1015*b* of socket member 1010 to clear the shoulders 2004 and 2005 of tubular member 2000 when socket member 1010 is pivoted between a first position in which it is axially aligned with the work-piece shaft 7000 and a second position in which the axis of the socket member 2000 is at substantially a right angle to the axis of the work-piece shaft 7000.

When the socket member 1010 is pivoted to the first axially aligned position, the flat inner walls 1015*c* and 1015*d* of ears 1015*a* and 1015*b* of socket member 1010 are lined up respectively with the flat outward facing sides 2002 and 2003 of tubular member 2000 for sliding engagement and to permit tubular member 2000 to slide forward on shaft 7000 to a second forward position in which the end portion 9 of shaft 7000 is retracted a sufficient distance to bring the ears 1015*a* and 1015*b* into abutting engagement against shoulders 2004 and 2005 respectively with flat inner walls 1015*c* and 1015*d* of said ears in full facing contact respectively with flat outward facing sides 2002 and 2003 of tubular member 2000. In such position, the socket member 1010 is locked in place in the axially aligned position with work-piece shaft 7000 until the tubular member 2000 is moved rearward.

Lock means are provided to hold the elongated tubular member 2000 and work-piece shaft 7000 in said second position wherein the tubular member 2000 has been moved forward and the shaft 7000 retracted relative to the tubular member. The lock means includes a recessed bore 2020 formed in work-piece shaft 7000 in which a compression spring 2021 is seated. A detent ball 2022 is placed on the spring 2021 for movement into recess 2020 when pressure is applied and being biased outwardly of the recess 2020 to partially seat in a corresponding recess 2023 opening from the inner wall of axial bore 4 of tubular member 2000. The recess 2023 opening from the inner wall of tubular member 2000 is in registration with recess 2020 of shaft 7000 and with detent ball 2022 when tubular member 2000 and shaft 7000 are in said second position, enabling detent ball 2022 to partially seat in both recess 2020 and 2023 under bias of spring 2021 thereby locking said members in the second position. Application of axially directed force to elongated tubular member 2000 in the rearward direction while holding shaft 7000 from axial movement will enable unseating of detent ball 2022 from recess 2023 and movement of tubular member 2000 rearwardly of shaft 7000 to the aforesaid first position.

When in the first position, the ears 1015*a* and 1015*b* are again able to clear the shoulders 2004 and 2005 for pivoting socket member 1010 to the second or right angle position relative to the work-piece shaft 7000. In such right angle position, the flat inner walls 1015*c* and 1015*d* of the ears are lined up respectively with the flat outward facing sides 2002 and 2003 of tubular member 2000 to again enable sliding movement forward of the tubular member 2000 to the aforesaid second position in which the tubular member 2000 is forward and shaft 7000 is retracted relative to each other, and in which flat inner walls 1015*c* and 1015*d* of the ears are in full facing contact with the respective flat outward facing sides 2002 and 2003 of tubular member 2000. At such time, the shoulders 2004 and 2005 are in full facing abutting engagement against the side edges 1015*e* and 1015*f* of the ears 1015*a* and 1015*b* of socket member 1010. When in such position, the elongated tubular member being locked in such position by detent ball 2022 as described above, the socket member 1010 is locked in place in the substantially right angle position until the tubular member 2000 is again moved rearwardly to enable the ears 1015*a* and 1015*b* to again clear shoulders 2004 and 2005 for pivoting the socket member 1010 to the axially aligned position.

A projecting stop member 7001 may also be provided extending outwardly from work-piece shaft 7000 to limit the rearward movement of elongated tubular member 2000. The stop member 7001 is positioned on shaft 7000 at such location that the rear wall 2024 of tubular member 2000 abuts against stop member 7001 when tubular member 2000 is in its rearward first position relative to work-piece shaft 7000. Rear wall 2024 of the tubular member 2000 is inset from the rearward end 2025 of tubular member 2000, with an annular overhang portion 2026 of the outer wall of tubular member 2000 extending rearwardly from rear wall 2024 a distance slightly in excess of the distance tubular member 2000 moves on shaft 7000 from its said rearward first position to its said forward second position thereon. In this way the projecting stop member 7001 is concealed under the annular overhang portion 2026 even when tubular member 2000 is moved forwardly to its second position and locked in place in said second position by said detent ball 2022 partially seating in recess 2023 under bias of compression spring 2021.

The socket member 1010 includes a socket cavity 12 having a conventional polygonal or ribbed inner side wall or cross-section to receive the correspondingly cross-sectioned shank end 13 of a tool 14 such as the screwdriver tip shown in the drawing. The socket cavity 12 is open to both ends 1011 and 1012 thereof, thereby providing a through passageway whereby the shank end 13 of the tool 14 may pass completely through the cavity 12 to abut against the end 9 of work-piece shaft 7000 when the socket member 1010 is in the axially aligned position with shaft 7000, and to abut against the facing outer wall portion of elongated tubular member 2000 when socket member 1010 is in the right angle position relative to work-piece shaft 7000.

When the socket member 1010 is in the axially aligned position, the through-passageway provided by socket cavity 12 open at both ends is axially aligned with and open to the axial bore 4 of elongated tubular member 2000. Thus, when the shank end 13 of the tool 14 is inserted into the said through-passageway of cavity 12 it may be pushed all the way through such cavity 12 and the shank end 13 of the tool 14 then enters the axial bore 4 of elongated tubular member 2000 for a short distance before abutting against the forward end 9 of work-piece shaft 7000 when tubular member 2000 is in the forward position. In this position, the tool 14 extending completely through the socket member 1010 and into the elongated tubular member 2000 completely locks the socket member 1010 in the axially aligned position relative to work-piece shaft 7000 to which it is pivotally connected at the forward end 9. The socket member 1010 cannot be pivoted to the right angle position until either the elongated tubular member is retracted enough, or the tool 14 is withdrawn from the socket member far enough, to clear the opening to axial bore 4 and the forward end 2001 of tubular member 2000. This construction in which the end 13 of tool 14 extends into the bore 4 of tubular member 2000 a short distance can be seen best in the sectional view shown in FIG. 23. The shank 13 of tool 14 includes an annular groove 13*a* which receives annular ring 12*a* when the shank 13 is fully received through cavity 12 and partway into the axial bore 4 of elongated tubular member 2000, when socket member 1010 is in the axially aligned position. When the user feels annular ring 12*a* snap into annular groove 13*a*, he knows that the tool 14 has been fully inserted to the point that a portion of the shank 13 has been received in the axial bore 4 of elongated tubular member 2000 when in its forward position, making it impossible for pivot tip member 1010 to pivot out of the axially aligned position until the elongated tubular member 2000 is either retracted or the tool 14 is withdrawn.

We claim:

1. A pivot tip tool, comprising a hand grasp member, an elongated work-piece shaft extending from said hand grasp member and terminating in a first end, a pivot tip member pivotally connected to said first end of said work-piece shaft and pivotable between a first working position in a axial alignment with said shaft and a second working position substantially normal to said shaft, an elongated member slidably mounted on said work-piece shaft and slidable between a first rearward position relative to said shaft and a second forward position relative to said shaft, and lock means to lock said pivot tip member in at least one of said positions.

2. A pivot tip tool as set forth in claim 1, wherein said one of said working positions in said first working position.

3. A pivot tip tool as set forth in claim 1, wherein said one of said working positions is said second working position.

4. A pivot tip tool as set forth in claim 1 wherein said lock means includes means to lock said pivot tip member in both of said working positions.

5. A pivot tip tool as set forth in claim 1, wherein said lock means includes groove means in one of said members comprising said pivot tip member and said elongated member, and ear means on the other of said members for cooperative locking engagement of said groove means and said ear means when said elongated member is in said second forward position.

6. A pivot tip tool as set forth in claim 5, including additional lock means, said additional lock means being associated with said elongated member and said work-piece shaft to releasably lock said elongated member in said second forward position.

7. A pivot tip tool as set forth in claim 6, including stop means associated with said elongated member and said work-piece shaft to stop said elongated member from further movement rearward on said work-piece shaft when it reaches said first rearward position.

8. A pivot tip tool as set forth in claim 4, wherein said lock means includes a pair of diametrically opposite grooves extending longitudinally rearward from the foward end of said elongated member for a first predetermined distance, said elongated member including a through passageway opening to said forward end, said pair of grooves each opening to said through passageway on diametrically opposite sides thereof, said work-piece shaft extending into said through passageway with diametrically opposite portions thereof facing said pair of grooves which open to said through passageway, a pair of flat sides on the forward end region of said elongated member on diametrically opposite sides thereof spanning said first preselected distance extending from said forward end of said elongated member, said pair of flat sides bordering respective ones of said pair of diametrically opposite grooves, a pair of flat faces extending outwardly at substantially right angles to respective ones of said pair of flat sides at the inward terminations of said pair of flat sides, said pivot tip member including a pair of oppositely disposed ears, each having a flat inward facing wall, said pair of ears having a longitudinal dimension substantially equal to the length of said first pre-determined dimension, pivot means pivotally connecting each of said ears in said pair to diametrically opposite sides of said work-piece shaft at locations thereof which face said pair of grooves in said elongated member, said flat inward facing walls of said pair of ears being spaced apart in respective planes which are each coplanar with respective ones of the diametrically opposite flat sides of said forward end region of said elongated member, said flat inward facing walls of said pair of ears being in sliding facing relationship with respective ones of said flat sides of said elongated member when pivotally mounted to said work-piece shaft, rearward edges of said pair of ears abutting against said flat faces which extend outwardly at substantially right angles to said flat sides of said elongated member when said pivot tip member is in said first working position and said elongated member is in said second forward position, side edges of said pair of ears abutting against said flat faces when said pivot tip member is in said second working position and said elongated member is in said second forward position.

9. A pivot tip tool as set forth in claim 8, wherein said pivot tip member includes a tool receiving socket.

10. A pivot tip tool as set forth in claim 9, wherein said socket is open at both opposite ends to provide a through passageway to receive the end of a tool completely through said passageway.

11. A pivot tip tool as set forth in claim 4, wherein said lock means includes a pair of diametrically opposite grooves extending longitudinally rearward from the forward end of said elongated member for a first predetermined distance, said elongated member including a through passageway opening to said forward end, said pair of grooves each opening to said through passageway on diametrically opposite sides thereof, said work-piece shaft extending into said through passageway with diametrically opposite portions thereof facing said pair of grooves which open to said through passageway, a pair of flat sides on the forward end region of said elongated member on diametrically opposite sides thereof spanning said first preselected distance extending from said forward end of said elongated member, said pair of flat sides bordering respective ones of said pair of diametrically opposite grooves, said pivot tip member including a pair of oppositely disposed ears, each having a flat inward facing wall, said pair of ears having a longitudinal dimension substantially equal to the length of said first pre-determined dimension, pivot means pivotally connecting each of said ears in said pair to diametrically opposite sides of said work-piece shaft at locations thereof which face said pair of grooves in said elongated member, said flat inward facing walls of said pair of ears being spaced apart in respective planes which are each coplanar with respective ones of the diametrically opposite flat sides of said forward end region of said elongated member, said flat inward facing walls of said pair of ears being in sliding facing relationship with respective ones of said flat sides of said elongated member when pivotally mounted to said work-piece shaft, wherein said pivot tip member includes a tool receiving socket, said socket being open at both opposite ends to provide a through passageway to receive the end of a tool completely through said passageway, said passageway being open to and axially aligned with said through passageway of said elongated member when said pivot tip member is in said first working position in axial alignment with said shaft, including a tool having a shank receivable in said through passageway of said socket of said pivot tip member and also receivable for a short distance into said through passageway of said elongated member when said elongated member is in said second forward position relative to said work-piece shaft, the forward end of said work-piece shaft being inset a short distance into said through passageway of said elongated member when said elongated member is in said second said forward position.

* * * * *